US007442051B2

(12) United States Patent
Jiang et al.

(10) Patent No.: US 7,442,051 B2
(45) Date of Patent: Oct. 28, 2008

(54) ELECTRICAL CONNECTOR WITH PRINTED CIRCUIT BOARD

(75) Inventors: Hong-Bing Jiang, Kunshan (CN); Chia-Huang Lin, Taipei (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/438,635

(22) Filed: May 22, 2006

(65) Prior Publication Data

US 2006/0261474 A1 Nov. 23, 2006

(30) Foreign Application Priority Data

May 20, 2005 (CN) ..... 2005 2 0072139

(51) Int. Cl.
*H01R 12/00* (2006.01)

(52) U.S. Cl. ..... 439/76.1

(58) Field of Classification Search ..... 439/76.1, 439/607, 260

See application file for complete search history.

(56) References Cited

U.S. PATENT DOCUMENTS 4,548,452 A * 10/1985 Gillett ..... 439/630
4,889,497 A * 12/1989 Riches ..... 439/76.1
5,051,099 A * 9/1991 Pickles et al. ..... 439/108
5,122,065 A * 6/1992 Dudek et al. ..... 439/76.1
5,679,008 A * 10/1997 Takahashi et al. ..... 439/76.1
6,007,382 A 12/1999 Wu
6,398,587 B1 6/2002 Chen et al.
6,561,850 B2 * 5/2003 Letourneau et al. ..... 439/607
6,612,876 B2 * 9/2003 Hyland ..... 439/607
7,134,884 B2 * 11/2006 Wang et al. ..... 439/76.1
7,204,648 B2 * 4/2007 Aronson ..... 439/62

* cited by examiner

*Primary Examiner*—Briggitte R Hammond
(74) *Attorney, Agent, or Firm*—Wei Te Chung

(57) ABSTRACT

An electrical connector (1) comprises an insulative housing (10) and a conductive member (20). The conductive member is assembled in the insulative housing, and comprises a plurality of first conductive pads (21) and a plurality of second conductive pads (22) arranged in a lateral direction of the conductive member, each first conductive pad comprises a contact sections (211) and a guiding section (210), each contact section is located behind corresponding guiding section alternatively aligned with the second conductive pads and the second pads in a front-to-back direction perpendicular to the lateral direction, and electrically separated with corresponding guiding section.

15 Claims, 4 Drawing Sheets

ELECTRICAL CONNECTOR WITH PRINTED CIRCUIT BOARD

BACKGROUND OF THE INVENTION

1. Field of the Invention

The present invention generally relates to an electrical connector, and more particularly to a Universal Serial Bus Connector with a printed circuit board.

2. Description of Prior Art

Portable electronic devices are found more and more applications in human livings with rapid developments of the science and technology nowadays. A portable electronic device needs to get smaller and smaller on one hand for portability and to incorporate as many electronic components therein as possible on the other hand for multi-function. Thus, electronic components accommodated in the portable electronic device and electrical connectors accommodated in the portable electronic device to connect peripheral electronic components, which are not put in the portable electronic device, to the portable electronic device are all made as small as possible to comply with the miniature of the device.

Universal Serial Bus (USB) connectors are often used to connect peripheral electronic components, such as Hard Disk Drive and CD ROM, to portable electronic devices. A mini USB connector having a small size is widely used in MP3 player. The conventional mini USB connector comprises four contacts for mating with the complementary connector. In some special, more contacts used to transmit the audio signals are needed. Thereby, the additional contacts cause the pitch between adjacent contacts is less than that of a usual mini USB connector. When a complementary connector is inserted into the connector, the contacts of the complementary connector is usually has a slightly movement along the a lateral direction, which may cause a misalignment with corresponding contacts, and further cause a short between the contacts of the mini USB connector.

Hence, it is desirable to have an improved USB connector to overcome the above-mentioned disadvantages of the prior art.

BRIEF SUMMARY OF THE INVENTION

Accordingly, the object of the present invention is to provide an electrical connector having a printed circuit with a plurality of conductive pads, which efficiently prevent a short with between two adjacent conductive pads when a complementary connector inserted.

In order to achieve the above-mentioned object, an electrical connector comprises an insulative housing and a conductive member. The conductive member is assembled in the insulative housing, and comprises a plurality of first conductive pads and a plurality of second conductive pads arranged in a lateral direction of the conductive member, each first conductive pad comprises a contact sections and a guiding section, each contact section is located behind corresponding guiding section alternatively aligned with the second conductive pads and the second pads in a front-to-back direction perpendicular to the lateral direction, and electrically separated with corresponding guiding section.

Other objects, advantages and novel features of the invention will become more apparent from the following detailed description of the present embodiment when taken in conjunction with the accompanying drawings.

DETAILED DESCRIPTION OF THE INVENTION

Figure 1:
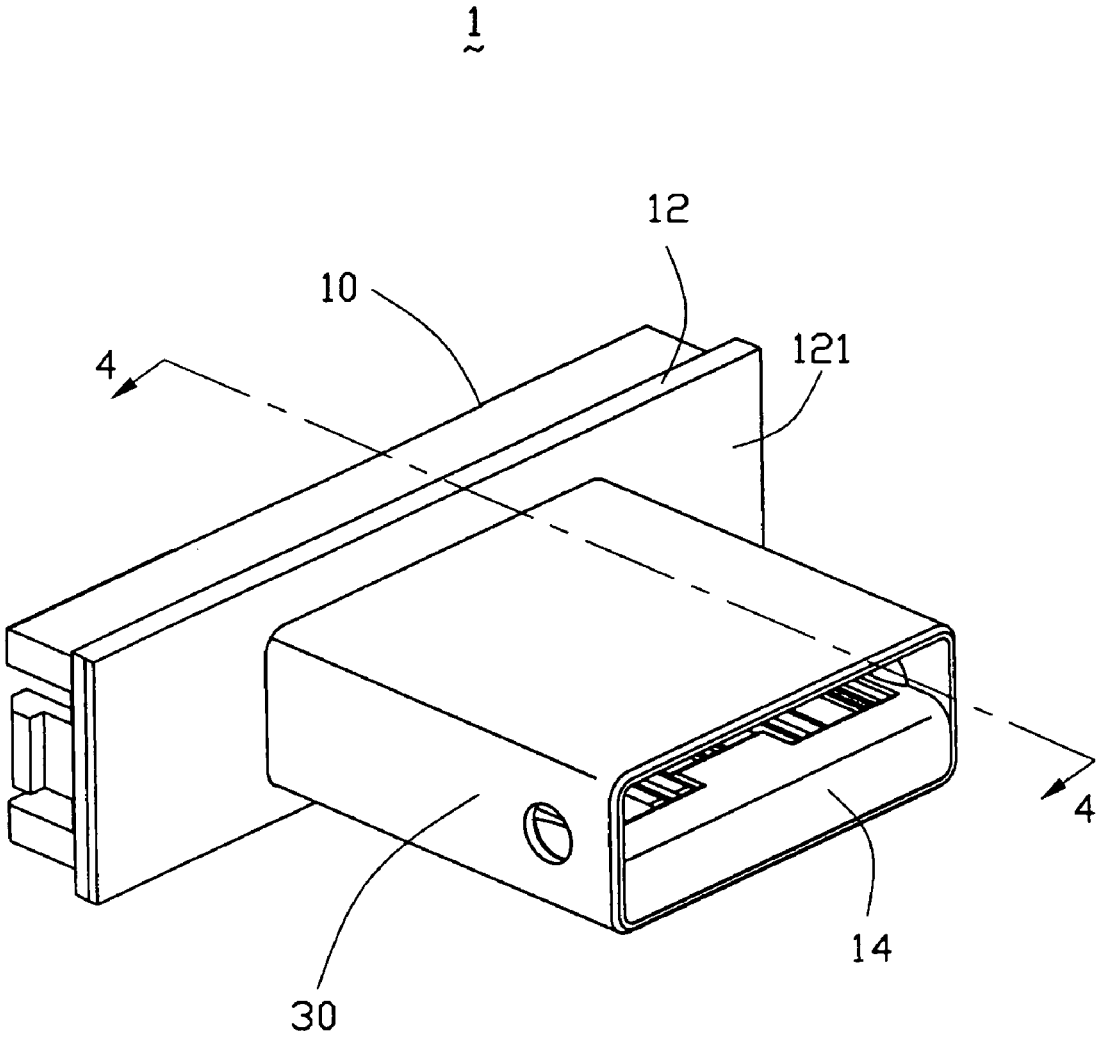
FIG. 1 is a perspective view of an electrical connector in accordance with the present invention.

Reference will now be made to the drawing figures to describe the present invention in detail.

Figure 3:
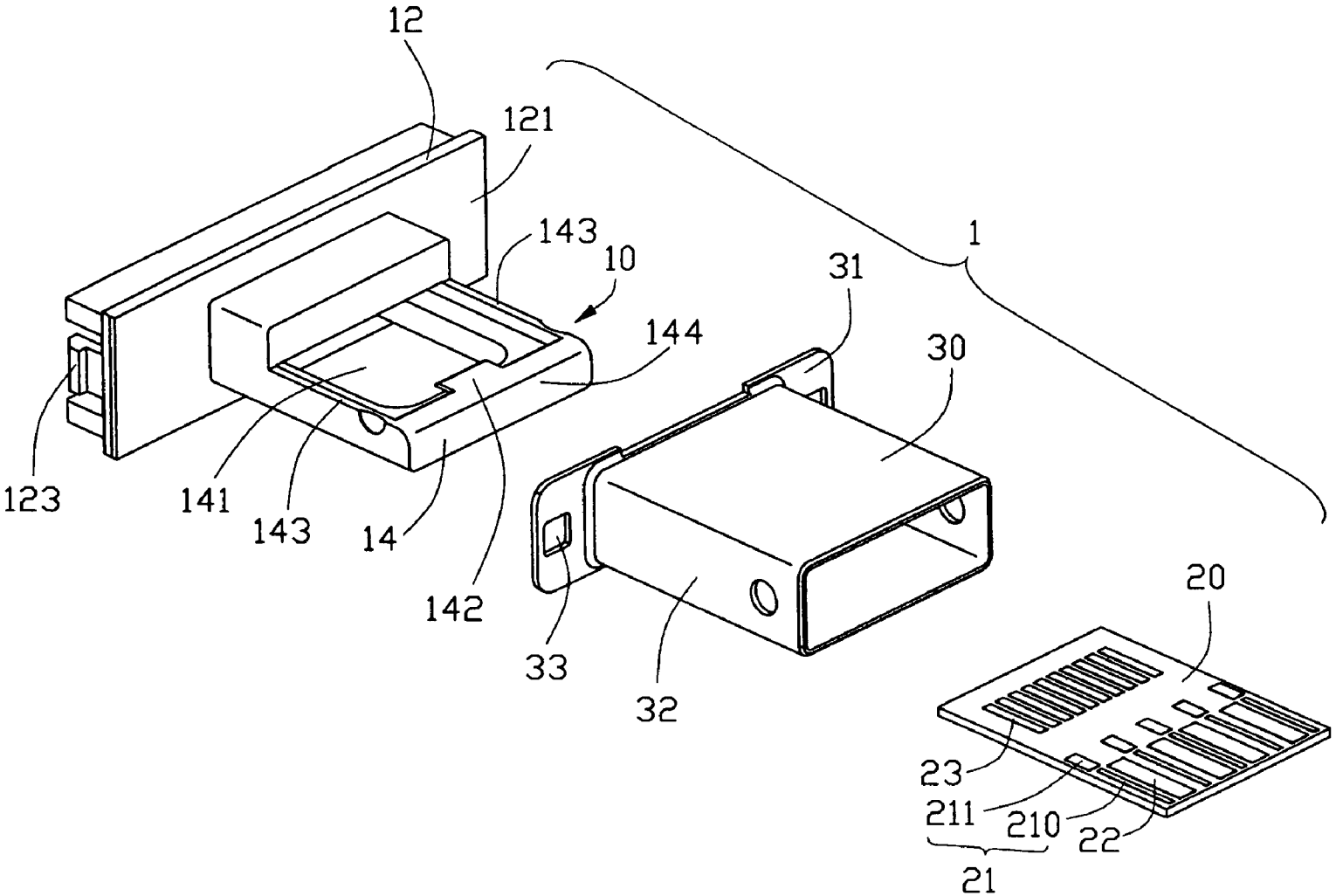
FIG. 3 is an exploded, perspective view of the electrical connector shown in FIG. 1.
Figure 4:
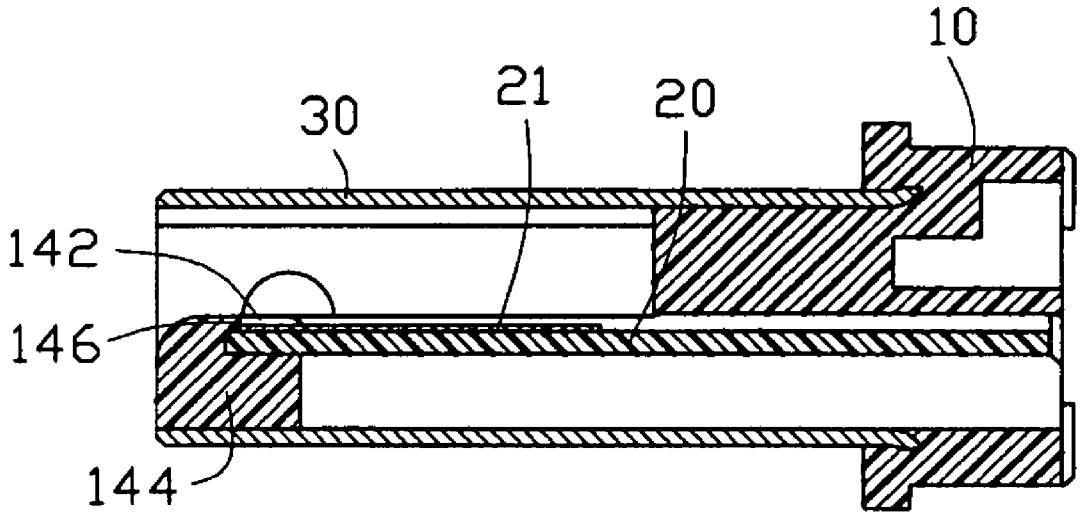
FIG. 4 is a cross-section view taken along line 4-4 of the electrical connector shown in FIG. 1.

Referring to FIGS. 1 and 3, an electrical connector 1 in accordance with the present invention comprises an insulative housing 10, a printed circuit board (PCB) 20 received in the insulative housing 10 and a shell 30 enclosing the insulative housing 10 to form a mating cavity.

Figure 2:
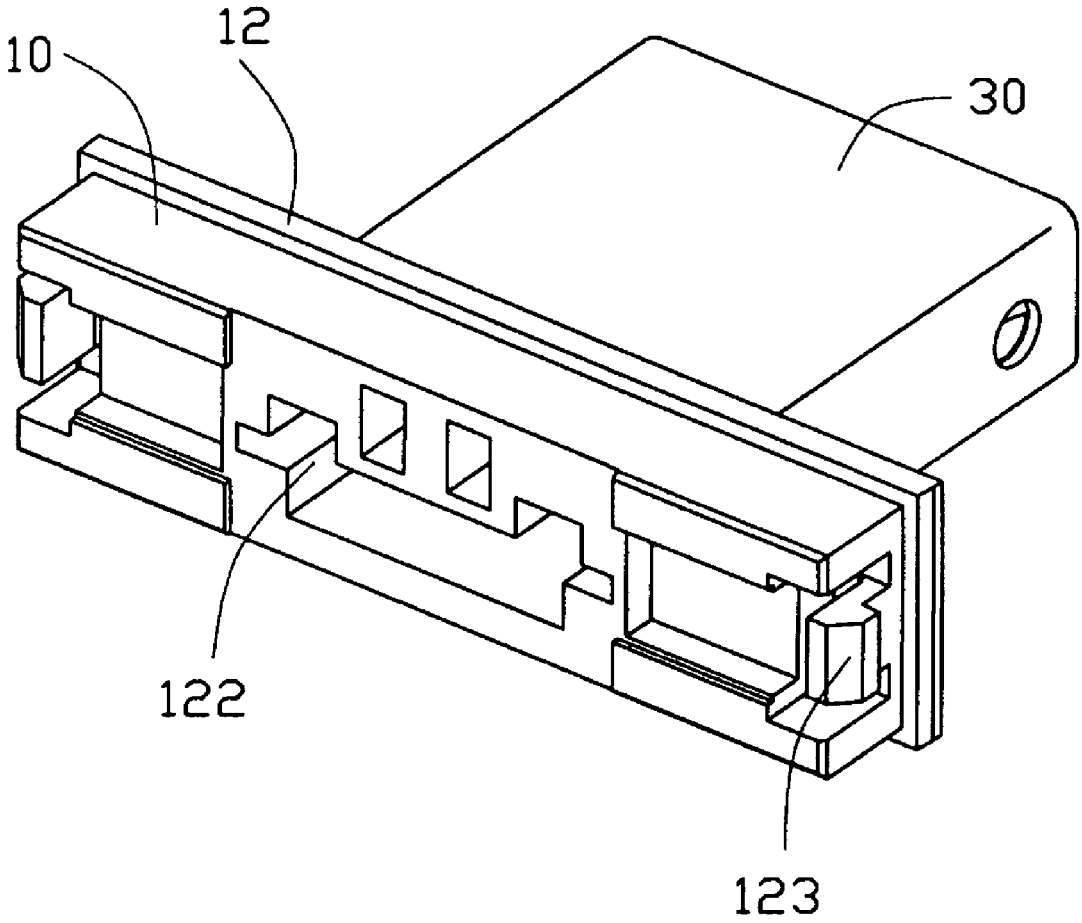
FIG. 2 is a view similar to FIG. 1, but taken from a different aspect.

Joining with FIGS. 2 and 3, the insulative housing 10 comprises a rectangular base portion 12, and a tongue-shape supporting bracket 14 extending forwardly therefrom. The base portion 12 has a receiving passage 122 extending therethrough along a front-to-back direction. A pair of latches 123 are formed at the lateral ends of the base portion 12, respectively, for engaging with an equipment (not shown). The supporting bracket 14 defines a cutout 141 in a center thereof communicating with the passage 122, a pair of lateral arms 143 and a front portion 144 surrounding the cutout 141. The supporting bracket 14 is partially cut from a top surface thereof to form a supporting portion (not labeled). A guiding portion 142 extends rearwardly from the center of the top surface of the front portion 144.

The shell 30 is seamless and fabricated by deep draw process. The shell 30 comprises a frame portion 32 and a pair of lateral ears 31 extending from the frame portion 32 outwardly. Each lateral ear 31 has a hole 33 thereon.

The PCB 20 forms a plurality of conductive pads thereon. The conductive pads comprise five first conductive pads 21, four second conductive pads 22, and nine third conductive pads 23. The first conductive pads 21 and the second conductive pads 22 are disposed at a front end of the PCB 20 with predetermined intervals and alternately along a lateral direction perpendicular to the front-to-back direction. The third conductive pads 23 are positioned at a rear end of the PCB 20 opposite to the first and second pads 21, 22 with predetermined interval. The four second conductive pads 22 can be used as a common USB connector. Each first conductive pad 21 comprises a rear contact section 211 having a relatively large dimension along the lateral direction and a front guiding section 210 having a relatively small dimension along the lateral direction with a gap formed therebetween. The contact sections 210 of the first pads 21 are arranged in a row along the lateral direction and located behind that of the second pads 22 along said front-to-back direction with dimension thereof smaller than that of second pads 22. The contact sections 211 of the first pads 21 essentially are not aligned and dimensionally consistent with corresponding guiding sections 210 thereof along said front-to-back direction and contact area (not labeled) of the second pads 22 is aligned and dimensionally consistent with a corresponding contact segment thereof along said front-to-back direction.

During assembly, the lateral ears 31 of the shell 30 are inserted-molded with the base portion 12 of the insulative housing 10, and the frame portion 32 encloses the supporting bracket 14 of the insulative housing 10. The shell 30 and the supporting bracket 14 define a mating cavity 147 along the front-to-back direction for mating and unmating. The holes 33 increase the retaining force between the shell 30 and the insulative housing 10. The PCB 20 is inserted into the passage 122 of the base portion 12 of the insulative housing 10 along a back-to-front direction, and is located above the cutout 141, and is supported by supporting portion of the supporting bracket 14. A front edge of PCB 20 is partially located below the supporting bracket 14, thus, the top surface of supporting bracket 14 is higher than the conductive pads 21, 22. The first conductive pad 21 forms a first mating interface for mating with a first connector (not shown), the first and the second conductive pads 21, 22 together form a second mating interface for mating with a second connector (not shown). Thus, because of the existence of the guiding sections 210, the misalignment may not occur when mating with complementary connector. In addition contacts of the complementary connector may not slide on substrate of the PCB 20 directly due to the guiding sections 210, thus efficiently protecting the substrate of PCB 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing;

a conductive member assembled in the insulative housing, and comprising a plurality of first conductive pads and a plurality of second conductive pads arranged in a lateral direction of the conductive member, each first conductive pad comprising a contact section and a guiding section alternately aligned with the second conductive pads, the contact sections being located behind the guiding sections and the second pads in a front-to-back direction perpendicular to the lateral direction, and a gap being defined between each contain section and corresponding guiding section;

wherein the conductive member is a printed circuit board (PCB), and the PCB comprises a plurality third conductive pads opposite to the first and second conductive pads along front-to-back direction, and electrically connecting with corresponding first and second conductive pads.

2. An electrical connector, comprising:

an insulative housing;

a conductive member assembled in the insulative housing and defining a surface, and comprising a plurality of first metallic conductive pads and a plurality of second metallic conductive pads alternately arranged on the surface in a lateral direction of the printed circuit board, each first conductive pad defining a contact section and a guiding section; wherein the contact section is located behind the guiding section, the contact section is spaced from the guiding section with a gap on the surface in a front-to-back direction perpendicular to said lateral direction, and the contact section is wider than the guiding section;

wherein the contact section of the first conductive pad is completely located behind the neighboring second conductive pad in said front-to-back direction.

3. The electrical connector as claimed in claim 2, wherein a width of the contact section is not larger than a space between every adjacent two second conductive pads.

4. The electrical connector as claimed in claim 2, wherein a width of the contact section is not larger than another width of the second conductive pad.

5. The electrical connector claimed in claim 2, where a center line of the contact section is aligned with another center line of the corresponding guiding section in said front-to-back direction.

6. The electrical connector as claimed in claim 2, wherein the guiding section extends forwardly toward and terminates affront edge of the printed circuit board.

7. The electrical connector as claimed in claim 2, wherein the contact section and the corresponding guiding section of the first conductive pad is electrically separated from each other.

8. The electrical connector as claimed in claim 1, wherein the contact section and the guiding section are aligned in a line with each other along the front-to-back direction.

9. The electrical connector as claimed in claim 1, wherein the dimension of each second conductive pad along the lateral direction is larger than that of the guiding section of the first conductive pad.

10. The electrical connector as claimed in claim 1, wherein the dimension of each contact section along the lateral direction is larger than that of the guiding section of the first conductive pad.

11. The electrical connector as claimed in claim 1, wherein the conductive member is a printed circuit board (PCB).

12. The electrical connector as claimed in claim 11, wherein the insulative housing comprises a base portion and a supporting bracket extending from the base portion, the base portion defines a passage, and wherein the PCB is inserted through the passage along the front-to-back direction.

13. The electrical connector as claim 1, wherein the electrical connector comprises a shell enclosing the insulative housing.

14. The electrical connector as claim 13, wherein the shell has a lateral ear insert-molded with the insulative housing.

15. The electrical connector as claim 12, wherein the PCB is positioned on the supporting bracket.

* * * * *